US007798370B2

(12) United States Patent
Ciavarella et al.

(10) Patent No.: US 7,798,370 B2
(45) Date of Patent: Sep. 21, 2010

(54) UNIVERSAL COLLAR KEY

(75) Inventors: Nick E Ciavarella, Seven Hills, OH (US); Mark E Rosendranz, Parma, OH (US); Martin O'Toole, Chagrin Falls, OH (US); Detlev F Smith, Fairlawn, OH (US)

(73) Assignee: GOJO Industries, Inc., Akron, OH (US)

( * ) Notice: Subject to any disclaimer, the term of this patent is extended or adjusted under 35 U.S.C. 154(b) by 1248 days.

(21) Appl. No.: 10/692,906

(22) Filed: Oct. 25, 2003

(65) Prior Publication Data

US 2005/0092771 A1 May 5, 2005
US 2007/0272709 A9 Nov. 29, 2007

(51) Int. Cl.
*B67D 7/06* (2010.01)

(52) U.S. Cl. ..... 222/181.3; 222/153.09

(58) Field of Classification Search ..... 222/181.3, 222/173, 381.3, 181.2, 183, 165, 153.09, 222/383.1, 384, 385
See application file for complete search history.

(56) References Cited

U.S. PATENT DOCUMENTS

| | | | | | |
|---|---|---|---|---|---|
| 4,974,753 | A | * | 12/1990 | Tucker et al. | 222/181.2 |
| 5,464,125 | A | * | 11/1995 | Daansen | 222/156 |
| 5,638,989 | A | * | 6/1997 | Ophardt et al. | 222/105 |
| 5,810,204 | A | * | 9/1998 | Devlin et al. | 222/82 |
| D480,639 | S | | 10/2003 | Ciavarella et al. | |
| 6,729,503 | B2 | * | 5/2004 | DeKoning et al. | 222/183 |

FOREIGN PATENT DOCUMENTS

| | | | | |
|---|---|---|---|---|
| EP | 517683 | * | 12/1992 | 222/156 |

* cited by examiner

*Primary Examiner*—Lien T Ngo
(74) *Attorney, Agent, or Firm*—Renner, Kenner, Greive, Bobak, Taylor & Weber

(57) ABSTRACT

A universal collar key used in connection with a container that fits within the housing of a dispenser that has a keyed receiver, the universal collar key including a collar supported on the container, a first flange and a second flange extending radially outward from the collar and spaced axially to define a clearance for receipt of the receiver therebetween.

9 Claims, 7 Drawing Sheets

UNIVERSAL COLLAR KEY

RELATED PATENT APPLICATIONS

None.

FIELD OF THE INVENTION

The present invention generally relates to a dispenser having a housing in which a container filled with a product to be dispensed is received. More particularly, the present invention relates to dispensers that employ a keying system for matching a container to the appropriate dispenser. Most particularly, the present invention relates to a universal collar key that may be attached to the container and allow the container to be inserted in multiple dispenser housings despite any keying systems associated with those housings.

BACKGROUND OF THE INVENTION

Dispensers are commonly used to dispense fluids and powders such as lotions or soap, among others. For sake of simplicity, all dispensable products will be collectively referred to as "soap." These dispensers generally include a housing into which a container, such as a bag or bottle, containing the soap to be dispensed is inserted. To maximize the use of the volume within the housing, in terms of the soap stored, the container is often sized or contoured to fit a specific housing. To ensure that the proper container is used with the appropriate housing, a system of keying the containers to their appropriate housings has been developed.

One form of such a keying system incorporates a collar key that is attached to the container and interacts with a receiver within the housing to secure the container therein. To match the container to the housing, the collar key has projecting keys extending outwardly from its surface that are arranged to fit corresponding keyways formed in the receiver. For example, a container may have a collar key that includes a key in the form of an outwardly projecting vertical rib. The corresponding housing would have a keyway in the form of a vertically oriented slot sized to receive the vertical rib. By making alterations in the key shape, size or arrangement, containers have been made such that they will only fit a particular housing. In terms of manufacturing, this ensures that the proper container is used with the proper housing. From the user's perspective, this allows the user to order the correct replacement container and ensure that its maintenance staff inserts the proper container in the proper housing.

Despite these advantages, the proliferation of dispensers has led to some consumers having several different dispensers; each requiring a different container with the appropriate key. As a result, these consumers are faced with purchasing containers with several different keys. While purchasing a single container to fit all of these housings may result in a loss of capacity in some of the dispensers, consumers have indicated that simplifying the stocking and replacement of containers by providing a universal container is desirable. Aside from choosing an appropriately sized container that could be received in all of these dispensers, to provide proper fit and securement of the container within the dispenser, a collar key that allows a single container to be used in multiple housings is needed.

SUMMARY OF THE INVENTION

In view of the foregoing, an object of the present invention is to provide a collar key that may be used to fit a single container in multiple dispenser housings.

In light of this object, the present invention provides a universal collar key including a collar having a bottom edge, a first flange extending radially outward from the bottom edge at least a forward portion of the collar, and a second flange extending radially outward from the collar and axially spaced from the first flange to define a clearance for receiving a keyplate within the dispenser therebetween.

The present invention further provides a universal collar key used in conjunction with a container for securement of the container within a soap dispenser that has a housing that defines a container recess and has a receiver that includes a key plate, the container including a hollow body having a necked portion, a locating projection extending rearwardly from the neck portion; and the universal collar key including a collar defining a bore, wherein the neck portion is receivable within the bore, a pair of flanges extending rearwardly from the collar and axially spaced from each other for receipt of the key plate therebetweeen, and a notch formed in the collar for receiving the locating projection on the container, whereby insertion of the locating projection within the notch aligns the container relative to a universal collar key.

The present invention further provides a dispenser including a removable container; a pump in fluid communication with the container; a housing defining a recess for receiving the container and a receiver having a keyplate; and a universal collar key attached to the container having a first flange and a second flange that extend rearwardly relative to the housing and are axially spaced from one another to define a clearance for receiving the keyplate therebetween, whereby upon insertion of the container within the housing, the first and second flanges axially engage the receiver at either end of the keyplate to axially secure the container within the housing.

BRIEF DESCRIPTION OF THE PREFERRED EMBODIMENTS

Figure 1:
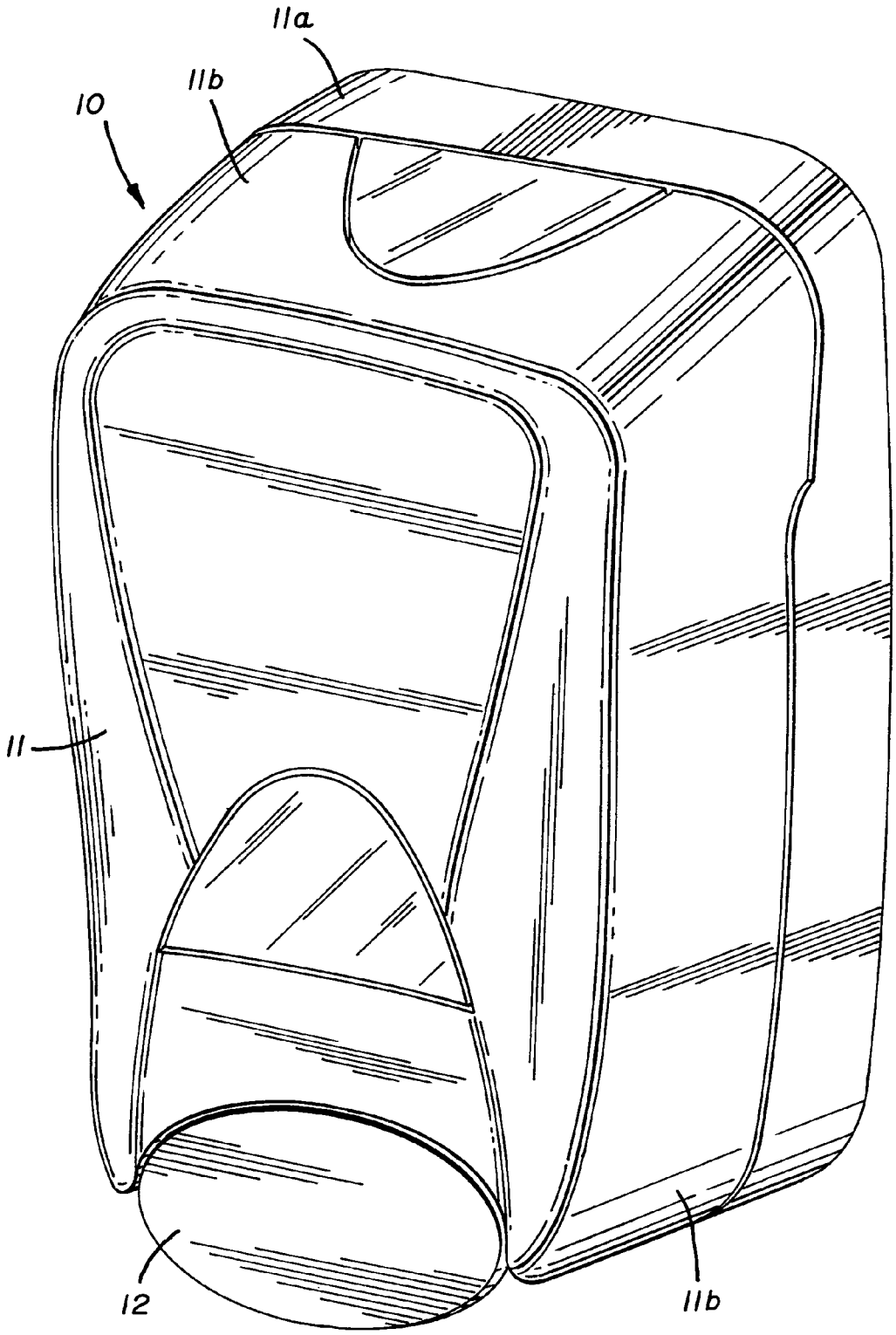
FIG. 1 is a perspective view of a dispenser according to the concepts of the present invention.

A dispenser, generally indicated by the numeral 10, is depicted in FIG. 1 of the drawings. Dispensers are widely available in the art and the dispenser 10 depicted in FIG. 1 is one example. The dispenser 10 generally includes a housing 11 that receives a container 20, such as a bag or bottle, that holds soap. The housing 11 may include a base 11*a* and a cover 11*b* which may be releasably attached to each other, as in a clamshell-like fashion, to facilitate replacement of an empty container 20.

Figure 2:
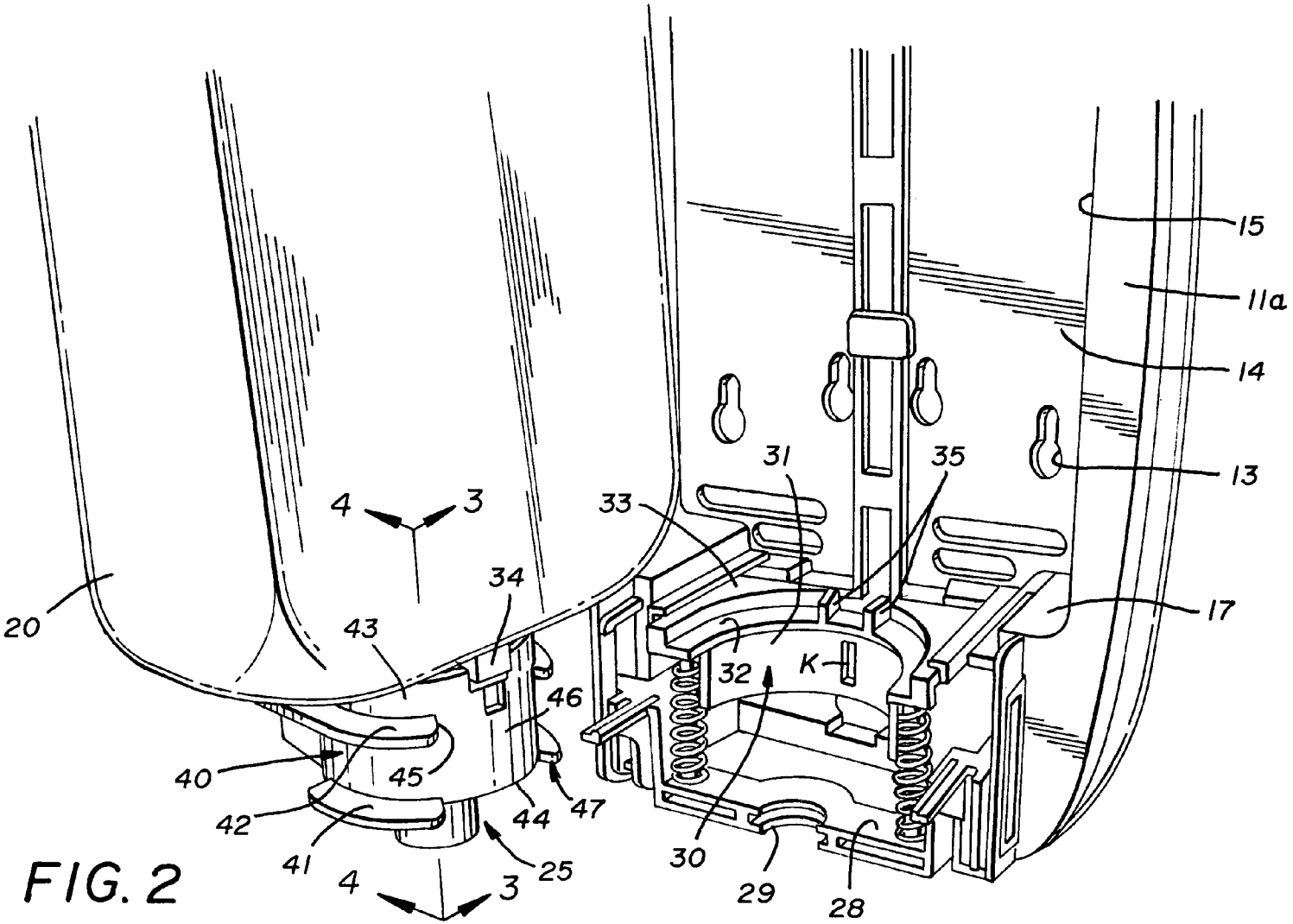
FIG. 2 is a partially fragmented perspective view of the dispenser depicted in FIG. 1 with the cover removed and the soap container rotated 90 degrees outwardly from the base of the dispenser to show details thereof.

As shown in FIG. 2, the base 11*a* may define the recess 15 into which at least a portion of container 20 is received. The base 11*a* may further include a shelf 17, which may be in the form of pair of shoulders that extend beneath the container 20 on either side of its neck 21.

Figure 3:
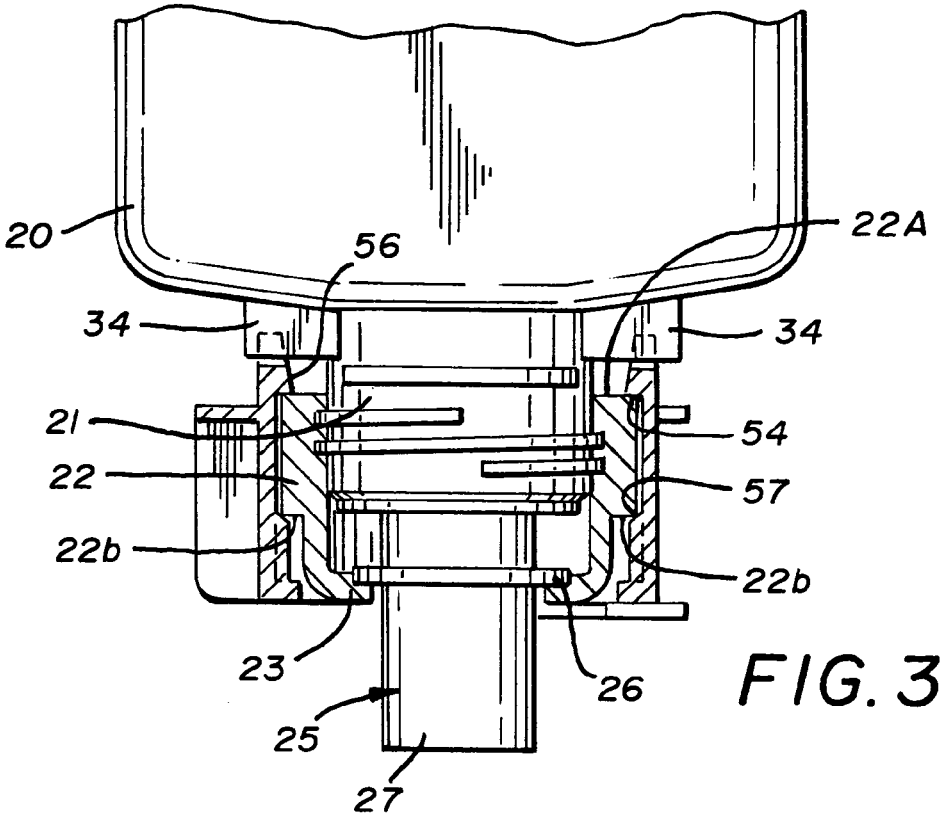
FIG. 3 is a partially fragmented sectional view of a container and universal collar key according to the concepts of the present invention as might be seen along line 3-3 in FIG. 2.
Figure 4:
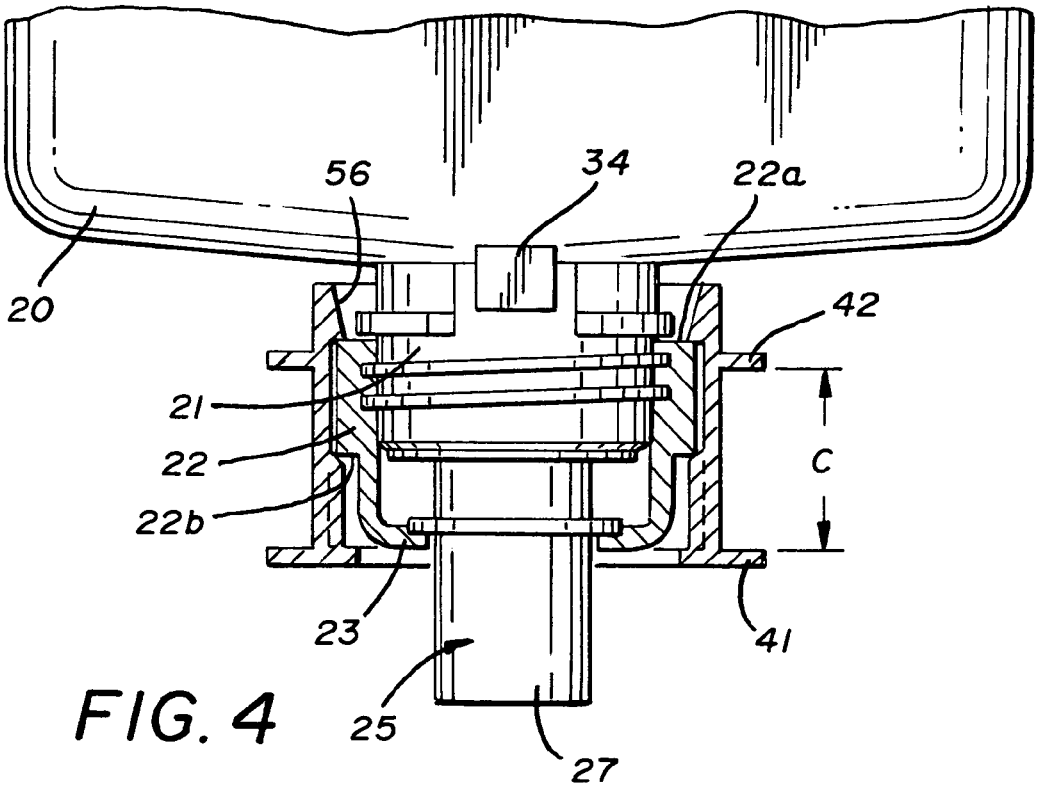
FIG. 4 is a partially fragmented sectional view similar to FIG. 3 as might be seen along line 4-4 in FIG. 2.

A pump generally indicated by the numeral 25, is typically attached to or formed integrally with the container 20 for dispensing soap therefrom. As shown, pump 25 may extend downward from container 20 between shoulders 17. With reference to FIGS. 3 and 4, pump 25 may, for example, be attached to the container 20 at a neck 21 extending downwardly from container 20, as by a threaded cap 22 that fits over the pump 25 and threads onto the neck 21. As shown, the pump 25 may include an annular rib 26 that rests against a shoulder 23 that extends radially inward from the cap 22. The nozzle 27 of the pump 25 protrudes axially outward from the cap 22, and, in the example shown, is moved upward to dispense soap from the container 20.

Returning to FIG. 2, it may be seen that a nozzle locating bar 28 is located generally at the bottom extremity of the base 11*a* for receipt of the nozzle 27 in a recess 29 formed therein. To allow the pump 25 to be driven axially inward to pump soap from the container, the locator bar 28 is movable with the nozzle 27 and may be made slidable in the axial direction and/or mounted on springs, as shown. In this way, a handle 12 that interacts with the locator bar 28 may be used to move the nozzle 27 and dispense soap from the container 20. In the example shown, the handle 12 is pivotally attached to the cover 16 and includes rearwardly extending arms (not shown) that engage the locator bar 28 to vertically displace the nozzle 27 and actuate the pump 25.

A receiver 30 is located above the locating bar 28 and is generally adapted to receive a collar key. As discussed previously, existing dispensers employ collar keys to ensure a unique fit between a given container 20 and housing 11. Typically, the collar carries a projecting key, and the receiver 30 defines a keyway specific to a given collar key. As an example, the receiver 30, shown in FIG. 2, is depicted with a keyway K, which is in the form of a vertical slot as one example. A matching collar key would have a vertical key extending therefrom and located such that the key would fit into the keyway K on the receiver 30. As will be appreciated, to key multiple containers 20 and housings 11, a variety of keyway arrangements have been established. With that in mind, a universal collar key according to the concepts of the present invention is generally indicated by the numeral 40 in the drawings. Before describing the universal collar key 40 in detail, it should be understood that the term "universal," as used herein, refers to the collar key's ability to work with more than one receiver 30.

Returning to the receiver 30, it may include a key plate 31 that is shaped to receive the collar 40 and, as shown for example in FIG. 2, may have a C-shaped backing plate 31 defining a semi-circular opening into which the collar 40 may be received. The key plate 31 has a height that generally corresponds to the height of a collar. A shelf 32 may be formed in receiver 30 and extend rearward above the key plate 31. The shelf 32 like key plate 31 may be semicircular. In the example shown, the shelf 32 is recessed from a top surface 33 of receiver 30 to generally form a semi-circular recessed area, with the shelf 32 extending radially outward of the keyplate 31. Locating tabs 35 may extend upwardly from a central portion of the shelf 32. In general, locating tabs 35 may be used to aid the user in positioning the container 20 within the recess 15, as by the interaction with a projection 34 formed on the container 20. In the example shown, the projection 34 extends rearwardly from the container 20 and, in the lateral sense, is located centrally adjacent the collar 40. To center the container 20 within the recess 15, the user would align the projection 34 between the tabs 35 and then slidably insert the projection 34 rearward along the shelf 32. In this way, the shelf 32 also provides some vertical support for the container 20.

To position and secure the container 20 relative to the receiver 30 without using a key, the universal collar key 40 includes a first flange 41 and a second flange 42 that extend from a cylindrical collar 43. Flanges 41 and 42 extend radially outward from the collar 43 and similar to projection 34 play a part in locating the container 20 within the recess 15. First flange 41 extends radially outward from the collar 43 at or near a bottom edge 44 of the collar 43. Second flange 42 is axially spaced from the first flange 41 to define a receiver clearance C (FIG. 4) that corresponds to the height of the receiver 30 or, as shown in the depicted example, the height of the key plate 31. In this way, the second flange 42 slides over the key plate 31 while the first flange 41 slides beneath the key plate 31 as the collar key 40 is inserted. Since there are no projecting keys on the surface of the collar 43, the collar key 40 may be completely inserted against the key plate 31 despite any keyway K used on the receiver 30. The first and second flanges 41, 42 may provide support for the container 20 and further limit any axial movement of the container 20 ensuring proper fit of the container 20 within the recess 15.

To provide a clearance for the locating tabs 35 extending upwardly from shelf 32, a notch 45 may be formed in the first flange 41 generally at the center of the leading surface 46 of the collar 43. A similar notch 47 may be provided within the second flange 42 to avoid contact with any downwardly projecting structures on the receiver 30. The surfaces of flanges 41, 42 on either side of notches 45, 47 may interact with any projections on receiver 30 to prevent rotation of the collar key 40 and thereby further secure the container 20.

Figure 5:
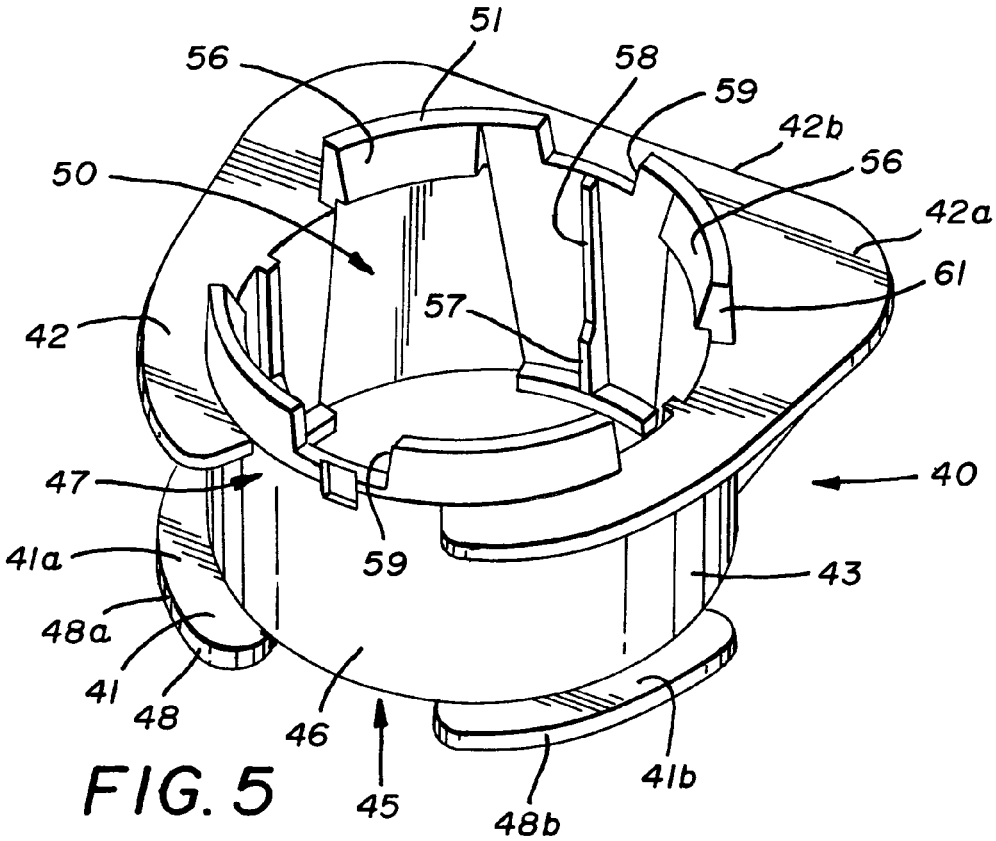
FIG. 5 is a rear perspective view of a universal collar key according to the concepts of the present invention.

Referring to FIG. 5, it may be seen that the first flange 41 may be divided into two segments 41*a*, 41*b* by notch 45. Further, the flange 41 does not necessarily extend around the entire circumference of the collar 43. As shown in FIG. 5, the first flange 41 may generally be confined to the leading half of the collar 43 extending through a 180° arc that is interrupted by the notch 45. It will be appreciated, however, that both flanges 41, 42 may have generally any configuration that protrudes radially outwardly from the collar 43 such that the receiver 30 is axially located therebetween upon insertion.

As illustrated above, due to existing receivers 30, to facilitate insertion of the collar key 40, the flanges 41, 42 may be contoured to fit a given receiver structure 30. For example, second flange 42 may be curved at its leading edge to fit within a semi-circular shelf recess 32. The edge 48 of first flange 41 may be similarly curved, such that both flanges 41, 42 have a semi-circular leading edge.

Figure 6:
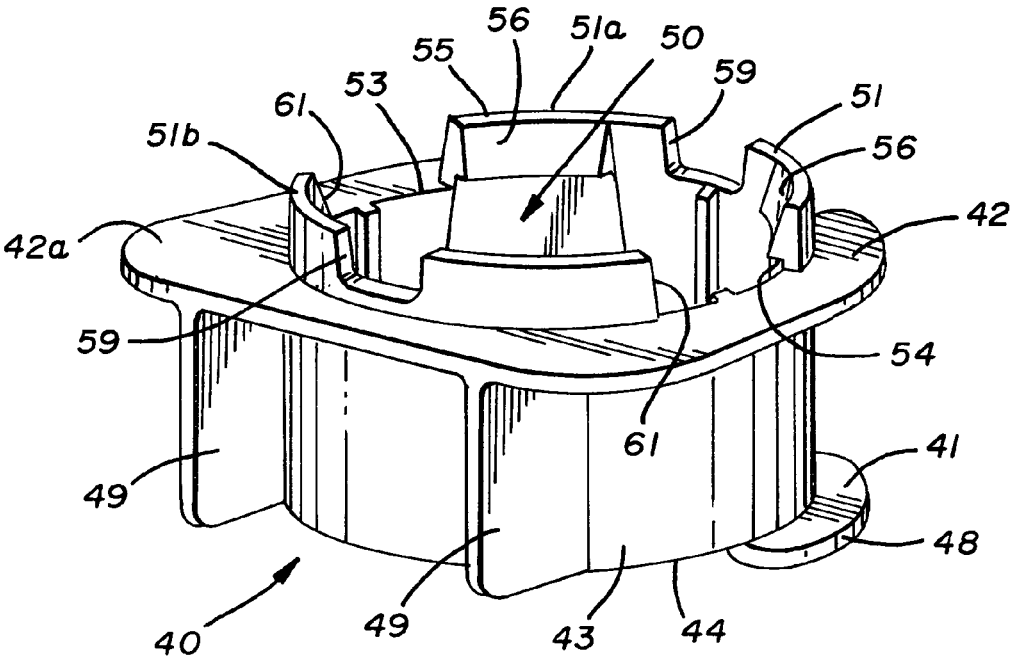
FIG. 6 is a front perspective view of a universal collar key according to the present invention.

To facilitate handling of the collar key 40, one or more holds 49 may be formed on the collar 43, as best shown in FIG. 6. These holds 49 may be recesses, indentations or openings, or positively projecting surfaces, such as the vertically extending tabs shown. In the example shown, the holds 49 extend rearwardly from the collar 43 and downwardly from the second flange 42. As will be appreciated, the holds 49 add strength and provide a convenient surface for grasping of the collar 43 facilitating the attachment of the collar key 40 within the receiver 30. In addition, holds 49 in the given example, help secure the collar key 40 by interacting with surfaces within the cover 11*b*. In particular, the vertical surfaces of holds 49 act as a stop to prevent rotation of the collar key 40 and, therefore, pump 25. In similar fashion, flange 42 may have a rear portion 42*a* that extends laterally and radially outward to provide an edge 42*b* that squarely contacts the cover 11*a* and helps the collar key 40 resist rotation. It will be appreciated that such rear portion 42*a* is optional. For example, flange 42 may simply be circular as depicted in the alternative collar key 140, shown in FIGS. 7-12, and described more completely below.

Notably, collapsible containers 20 are often used in the art and as the fluid is removed from the container 20 the suction within the container 20 draws the walls of the container inward deforming the container 20. When this happens, the deformation of the container creates forces that may cause the pump 25 to rotate or twist relative to the container 20, when not secured. This deformation or the spring action of the pump may further cause the pump 25 to move axially or laterally relative to the receiver 30. As can be seen from the above description, flanges 41, 42 and holds 49 serve to restrain the collar key 40 in all directions such that these forces that would dislodge or move the pump 25 or container 20 are checked, securing the container 20 without the need for the unique key and keyway system.

The collar key 40 may be attached to the container 20 in a variety of manners known in the art including attachment of the collar 43 to the neck 21 of the container 20 by threads, adhesives, or welds. In the example shown, collar key 40 snaps onto the neck of pump 25. To that end, the collar 43 defines a bore at 50 sized to receive the pump 25 and cap 22. The radially projecting cuff portion 22*a* of cap 22 is then conveniently used in the snap fit attachment of the collar key 40. It will be appreciated that, instead of cuff 22*a*, projecting surfaces on the container 20 could be used, and, thus for purposes of this feature, the cuff 22*a* may be considered to be a part of the container 20. To that end, the collar key 40 may include an attachment member 51 that engages the cuff 22*a*. In the example shown, a pair of attachment members 51*a*, 51*b* project upwardly from the top edge 53 of collar 43. Members 51 include a radially inward extending surface 54 (FIG. 3) that hangs over the cap 22 after the collar key 40 is forced upwardly on to the neck 21 of container 20. In this way, the collar 43 hangs on the cap 22. To facilitate the attachment of the collar 43 in this manner, an inner surface 56 that slopes radially inward as it extends axially downward may be provided between the radially inward projecting surface 54 and top edge 55. The sloped surface 56 may cause flexing of either the attachment member 51 or the cap 22 to facilitate sliding of the collar 43 over the cap 22. Once the sloped surface 56 clears the cap 22, the cap 22 or attachment member 51 may return to their original configuration, which may result in an audible "click" or "snap".

To further secure the collar key 40 on the container 20, a second radially inward projecting surface 57 may be provided on a vertically extending rib 58 formed on the interior surface of the collar 43. As best shown in FIG. 3, once the radially inward projecting surface 54 of attachment member 51 lies over the top surface 22*a* of the cap 22, the lower surface 22*b* of cap 22 abuts second radial inward projecting surface 57 such that the cap 22 is trapped between surfaces 54 and 57. In this position, ribs 58 contact the periphery of the cap 22 or container 20 to secure relative to the container 20.

As mentioned previously, the container 20 may have projections 34 that facilitate location of the container within the recess 15. These projections 34 may also be used to properly orient the container 20 relative to the collar key 40. To provide for this orientation, as best shown in FIGS. 5 and 6, the attachment members 51 may include a recess 59 corresponding to the projection 34. Similarly, the attachment members 51 may be spaced from each other defining a notch 61 therebetween. The effect of the recesses 59 and notch 61 is to create a crenelated annular flange about the circumference of the bore 50 extending axially outward from the top surface 53 of the collar 43. As discussed above, the projection 34 may extend rearward toward base 11*a* for receipt between tabs 35 and, thus, recess 59 may be located centrally at the leading end 46 of collar 43. Since containers 20 are often formed symmetrically, a similar recess 59 may be formed diametrically opposite the recess 59 on the forward edge 46. As best shown in FIG. 3, the projection 34 would then seat within the recesses 59. To facilitate proper attachment of the collar key 40 to the container 20, the notches 61 and recesses 59 may be differentiated from each other as by size or depth, as shown in FIG. 6. In this way, the collar key 50 may be quickly oriented by fitting the projections 34 in the appropriately sized recess 59.

In use, the collar key 40 is attached to or formed integrally with a container 20 as described above. With the collar key 40 attached, the container 20 may be placed within the housing 11 of a dispenser 10. The container 20 is of a size suitable for multiple housings 11. Similarly, the universal collar key 40 bypasses the keying systems used in multiple housings 11 with flanges 41, 42 that are spaced sufficiently to fit above and below a key plate 31 that defines a keyway K ordinarily used to receive a specific key on the collar. The radial extension of the flanges 41, 42 beyond the plane of the key plate 31 provides a positive stop to any undesired axial movement of the container 20 and serves to properly locate the container 20 in the axial sense. Thus, with the universal collar key 40 attached, the user may then insert a container 20 into a housing 11 without regard to the particular keyways K formed in the receiver 30.

Figure 7:
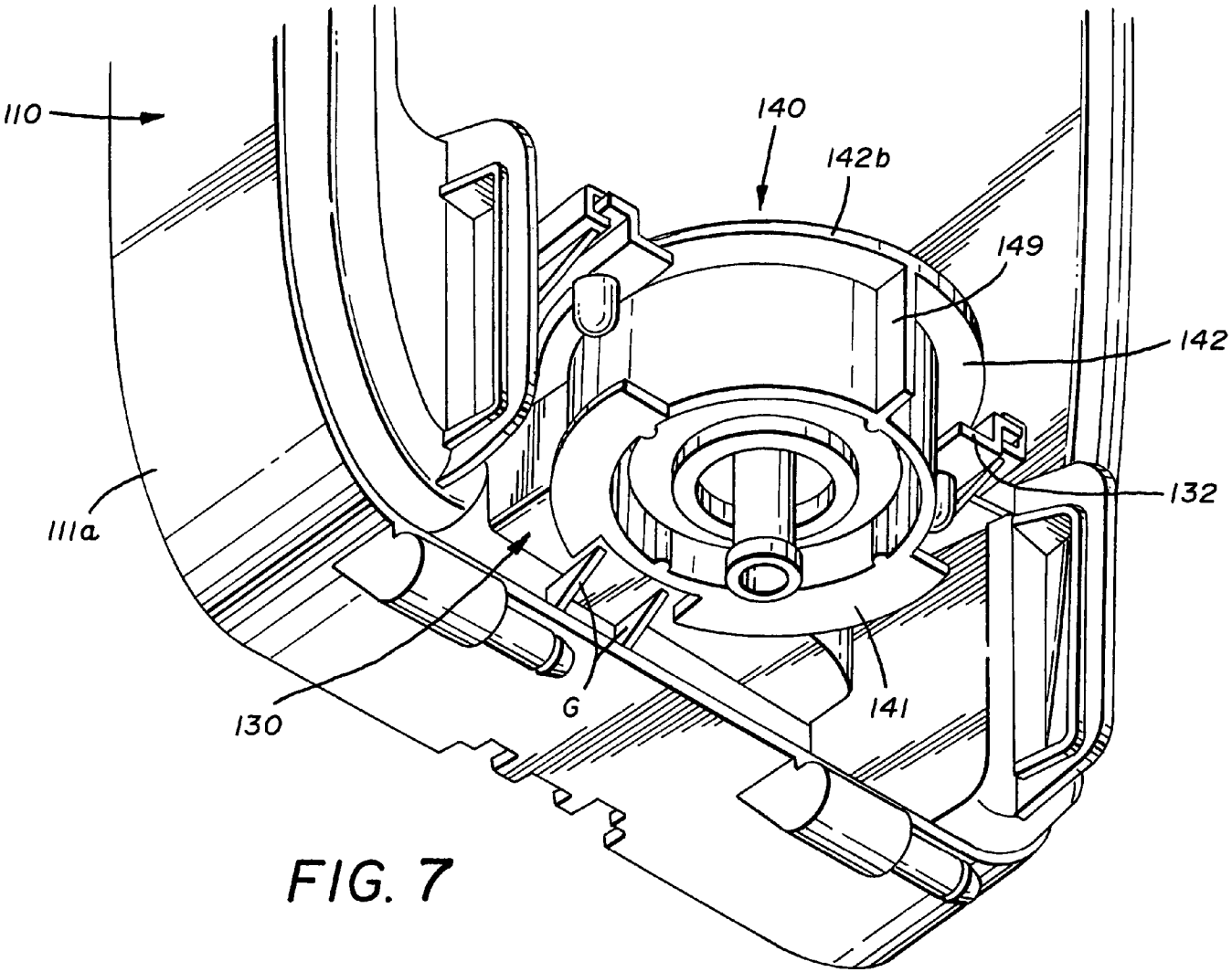
FIG. 7 is a partially fragmented perspective view of a dispenser according to the concepts of the present invention with the cover removed to show details of a collar key according to the concepts of the present invention.
Figure 8:
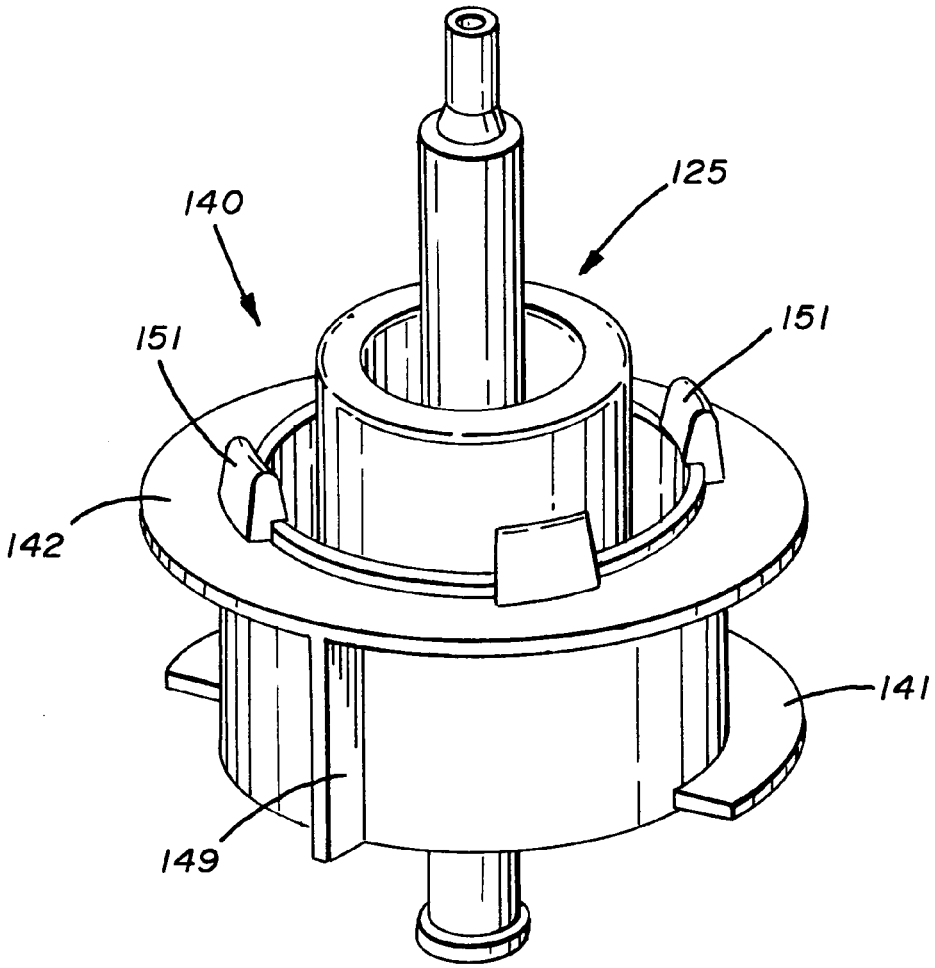
FIG. 8 is a perspective view of the collar key depicted in FIG. 7 shown attached to a pump.
Figure 9:
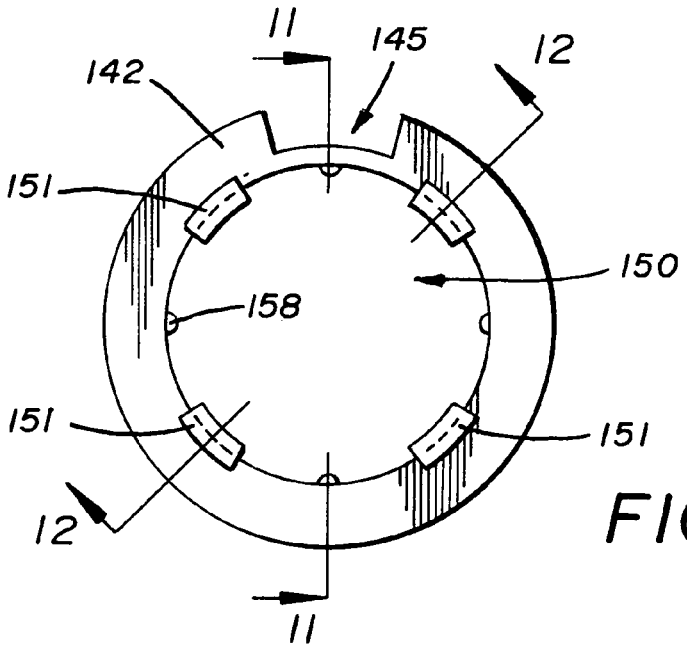
FIG. 9 is a top plan view of the alternate collar key.
Figure 10:
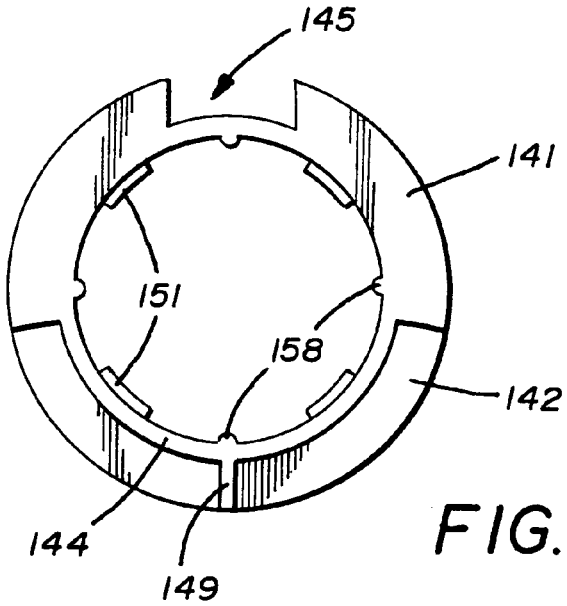
FIG. 10 is a bottom plan view of the alternate collar key.

An alternate embodiment of the present invention is depicted in FIGS. 7-12. Since the alternate embodiment has components similar to those shown in the embodiment depicted in FIGS. 1-6, like numerals will be used to depict like structures. An alternate dispenser is generally indicated by the numeral 110 and has a base 111*a* in which a pump assembly 125 is received. As shown in FIGS. 7 and 8, a pump 125 may be provided with an alternate collar key, generally indicated by the numeral 140 to secure the container irrespective of any keying mechanism on a receiver 130 within dispenser 110. As in the previous embodiment, the collar key 140 has a first flange 141 and a second flange 142 that are axially spaced a distance corresponding to the height of receiver 130, such that flanges 141, 142 may grasp the receiver 130 therebetween to axially secure the container. First flange 141 may be provided with a gap 145 located centrally on its leading edge 146 to accommodate protruding structures, such as gussets G within the base 111*a*. Flange 141 may extend forwardly to an extent sufficient that any rotation of the collar key 140 would cause contact between the gussets G thereby hold the collar key 140 in the appropriate position. To further prevent rotation, a hold 149, such as the vertical rib shown, man engage structures within the dispenser's cover.

In contrast to the previous embodiment, the rear edge 142*b* of second flange 142 may have a circular profile or otherwise be shaped to meet the space limitations of the cover of the dispenser 110.

Figure 11:
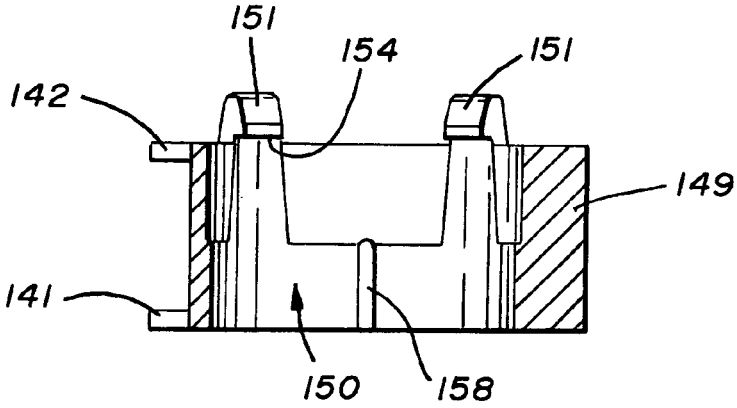
FIG. 11 is a sectional view as might be seen along line 11-11 in FIG. 9 depicting further details of the alternate collar key.
Figure 12:
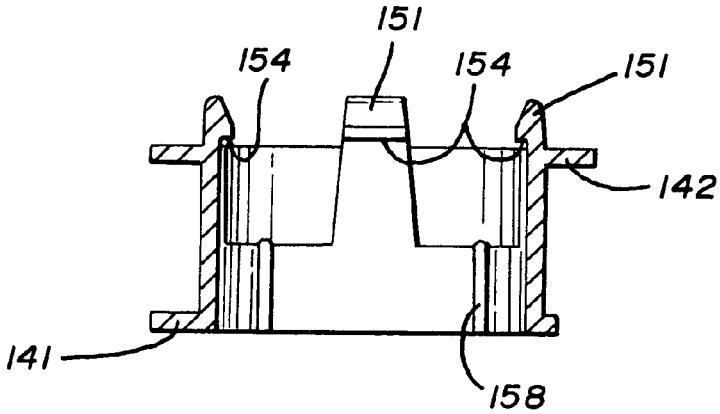
FIG. 12 is a sectional elevational view as might be seen along line 12-12 in FIG. 9.

With reference to FIGS. 8-12, collar key 140 may be adapted to attach to pump 125 (FIG. 8). To that end, the collar key 140 may define a bore 150 capable of receiving the pump 125 therein. Attachment members 151 extending upwardly from the second flange 142 may provide a snap fit when used in conjunction with inwardly projecting ribs 158. With reference to FIGS. 11 and 12, it may be seen that the ribs 158 are located at a lower portion of the bore 150 axially spaced from the radially inward projecting surface 154 of attachment members 151 such that a portion of the pump 125 may be grasped therebetween. With the collar key 140 attached to the pump 125, collar key 140 restrains movement of the pump 125 and correspondingly the container as described more particularly in the previous embodiment.

While a full and complete description of the invention has been set forth in accordance with the dictates of the patent statutes, it should be understood that modifications can be resorted to without departing from the spirit hereof or the scope of the appended claims.

What is claimed is:

1. A universal collar key for a container that is inserted within a housing of a soap dispenser having a keying system including a keyplate with a keyway to receive a complementary shaped collar key associated with an intended container therein, the universal collar key comprising:

a collar secured to the container and having a first flange and a second flange extending radially therefrom, said flanges being axially spaced from each other to define a clearance for receiving the keyplate therebetween upon insertion of the container, said collar having a keyless surface such that the universal collar key bypasses the keying system of the soap dispenser that is intended for the intended container;

a bore formed in said collar for receiving a portion of the container; and an attachment assembly located about the bore including an attachment member extending axially outward from the collar and having a surface extending radially inward therefrom for engagement with the portion of the container.

2. The universal collar key of claim 1, wherein said attachment member further includes a sloped surface that extends radially outward and axially upward from said radially inward extending surface to an edge of said attachment member.

3. The universal collar key of claim 2 further comprising a second radially inward extending surface extending from said collar into said bore and axially spaced from said radially inward extending surface on said attachment member, whereby the portion of the container is held between said surfaces.

4. The universal collar key of claim 1 further comprising a hold formed on the collar.

5. A universal collar key for a container that is inserted within a housing of a soap dispenser having a keying system including a keyplate with a keyway to receive a complementary shaped collar key associated with an intended container therein, the universal collar key comprising:

a collar secured to the container and having a first flange and a second flange extending radially therefrom, said flanges being axially spaced from each other to define a clearance for receiving the keyplate therebetween upon insertion of the container, said collar having a keyless surface such that the universal collar key bypasses the keying system of the soap dispenser that is intended for the intended container; and a hold formed on the collar, wherein said hold includes a pair of vertically extending tabs extending forwardly from said collar.

6. A universal collar key for a container that is inserted within a housing of a soap dispenser having a keying system including a keyplate with a keyway to receive a complementary shaped collar key associated with an intended container therein, the universal collar key comprising:

a collar secured to the container and having a first flange and a second flange extending radially therefrom;

said flanges being axially spaced from each other to define a clearance for receiving the keyplate therebetween upon insertion of the container, said collar having a keyless surface such that the universal collar key bypasses the keying system of the soap dispenser that is intended for the intended container, wherein said collar defines a bore for receipt of a neck of the container, wherein a plurality of spaced tabs extend upwardly from said collar about said bore defining a plurality of notches therebetween for receipt of a projecting portion of the container therebetween.

7. The universal collar key of claim 6, wherein said collar has a leading surface relative to its insertion within the housing, wherein at least one of said plurality of notches formed between said plurality of tabs is located above said leading surface.

8. A universal collar key used in conjunction with a container for securement of the container within a soap dispenser that has a housing defining a container recess and a receiver having keyplate, the container comprising a hollow body having a necked portion, a locating projection extending rearwardly from said neck portion; and the universal collar key comprising a collar defining a bore, wherein said neck portion is receivable within said bore, a pair of flanges extending rearwardly from said collar and axially spaced from each other for receipt of the keyplate therebetween, and a notch for receiving said locating projection on said container formed in said collar, whereby insertion of said locating projection within said notch aligns the container relative to a universal collar key.

9. The container and universal collar key of claim 8, wherein the universal collar key is attached by snap-fitting said collar to said neck portion of the container.

* * * * *

UNITED STATES PATENT AND TRADEMARK OFFICE

CERTIFICATE OF CORRECTION

PATENT NO. : 7,798,370 B2
APPLICATION NO. : 10/692906
DATED : September 21, 2010
INVENTOR(S) : Nick E Ciavarella et al.

It is certified that error appears in the above-identified patent and that said Letters Patent is hereby corrected as shown below:

On the title page, item (75), reading "Mark E Rosendranz" should read "Mark E Rosenkranz"

Signed and Sealed this

Sixteenth Day of November, 2010

David J. Kappos

David J. Kappos
*Director of the United States Patent and Trademark Office*